United States Patent [19]

Hoeber

[11] Patent Number: 4,781,017

[45] Date of Patent: Nov. 1, 1988

[54] PROCESS AND DEVICE TO PIECE TO AN OPEN-END FRICTION SPINNING DEVICE

[75] Inventor: W. Gerhard Hoeber, Ingolstadt, Fed. Rep. of Germany

[73] Assignee: Schubert & Salzer, Ingolstadt, Fed. Rep. of Germany

[21] Appl. No.: 55,627

[22] PCT Filed: Aug. 2, 1986

[86] PCT No.: PCT/DE86/00318

§ 371 Date: May 8, 1987

§ 102(e) Date: May 8, 1987

[87] PCT Pub. No.: WO87/01742

PCT Pub. Date: Mar. 26, 1987

[30] Foreign Application Priority Data

Sep. 20, 1985 [DE] Fed. Rep. of Germany ..... 3533587

[51] Int. Cl.[4] ..... D01H 15/00; D01H 7/885

[52] U.S. Cl. ..... 57/263; 57/301

[58] Field of Search ..... 57/261, 263, 301, 400, 57/401, 304, 300

[56] References Cited

U.S. PATENT DOCUMENTS

| | | | |
|---|---|---|---|
| 3,521,440 | 7/1970 | Oskin et al. | 57/58.89 |
| 4,060,966 | 12/1977 | Konig | 57/58.89 |
| 4,315,398 | 2/1982 | Parker et al. | 57/58.95 |
| 4,380,892 | 4/1983 | Parker et al. | 57/401 |
| 4,384,451 | 5/1983 | Elias et al. | 57/263 |
| 4,541,233 | 9/1985 | Raasch et al. | 57/263 |
| 4,541,235 | 9/1985 | Raasch | 57/263 |
| 4,586,325 | 5/1986 | Wassenhoven | 57/263 |
| 4,606,187 | 8/1986 | Stahlecker | 57/263 X |
| 4,612,763 | 9/1986 | Stahlecker | 57/263 X |
| 4,617,790 | 10/1986 | Stahlecker | 57/263 |

FOREIGN PATENT DOCUMENTS

| | | |
|---|---|---|
| 338666 | 12/1977 | Austria . |
| 52412 | 5/1982 | European Pat. Off. . |
| 2103171 | 9/1972 | Fed. Rep. of Germany . |
| 3141733 | 6/1982 | Fed. Rep. of Germany . |
| 3436295 | 4/1985 | Fed. Rep. of Germany . |
| 3342472 | 6/1985 | Fed. Rep. of Germany . |
| 1170869 | 11/1969 | United Kingdom . |
| 2042599 | 9/1980 | United Kingdom . |
| 2158468 | 11/1985 | United Kingdom . |

*Primary Examiner*—Donald Watkins

*Attorney, Agent, or Firm*—Dority & Manning

[57] ABSTRACT

For piecing to an open-end friction spinning device with two friction spinning elements normally driven in the same direction of rotation and forming a nip therebetween, of which friction spinning elements at least one is capable of being subjected to suction, fibers are continuously fed to the nip and are then immediately removed from same. While fiber feeding continues uninterruptedly, the removal of fibers from such nip is then discontinued, so that fibers remain in the nip and form a rotating accumulation of fibers. A yarn end is then introduced to such accumulation of fibers. Newly formed yarn is then drawn off from the nip while fibers being fed continuously to such nip are continuously formed into such yarn. For such removal of fibers, a controllable suction air nozzle may be directed towards the above-mentioned nip from a side of the friction spinning elements opposite such nip. The friction spinning elements can also be moved radially apart in relation to each other to enhance transfer of fibers thereon to the controllable suction air nozzle or some other substantially equivalent fiber removal device, such as a conveyor belt.

51 Claims, 3 Drawing Sheets

PROCESS AND DEVICE TO PIECE TO AN OPEN-END FRICTION SPINNING DEVICE

BACKGROUND AND SUMMARY OF THE INVENTION

The instant invention relates to a process for piecing to an open-end friction spinning device in which a yarn is back-fed into the nip, is connected therein with fibers and is then again drawn off continuously from said nip. The invention also relates to a device to carry out such process.

When a yarn breaks, or following a stoppage of the spinning process due to other causes, the feeding device is immediately stopped in order to prevent unnecessary fiber feeding which would clog and damage the spinning device. However, the opening roll continues to run as a rule, since stopping it separately for each spinning station would not only require a great technical effort, but starting and slowing down would take up a considerable amount of time. As a consequence, the fiber tuft which extends from the stopped feeding device into the range of the opening roll would be completely removed.

Based on the recognized fact that each stoppage of the feeding device causes a certain amount of damage of the fiber tuft, depending on the duration of the stoppage, proposals have been made in the past to divert the stream of fibers on its way to the fiber collecting surface and to guide it past the fiber collecting surface into a suction device. For this purpose, suction openings (see British patent publication 1,170,869 corresponding with U.S. Pat. No. 3,521,440) or compressed air openings (see German patent publication 3,104,444 corresponding with U.S. Pat. No. 4,384,451) have been provided in the feeding channel. Although undamaged fibers are fed precisely at the desired moment to the fiber collecting surface thanks to the uninterrupted fiber feeding and opening process, such openings within the highly sensitive fiber conveying path between the opening roll and the fiber collecting surface interfere with the spinning process. None of these proposals were therefore of practical significance.

It is the object of the instant invention to create a process and a device for piecing to an open-end friction spinning device which makes it possible to carry out faultless and secure piecing without affecting the subsequent spinning process.

This objective is achieved according to the invention in that the fibers are fed continuously to the nip but are then first taken out of the nip, in that the friction spinning elements are driven in spinning direction and in that the removal of the fibers is ended, in that the yarn end is back-fed to the forming accumulation of fibers and in that the yarn is drawn off from the nip while the fibers fed to said nip are continuously incorporated into the yarn. The removal of the fibers from the nip causes first of all those fibers which had been damaged through stoppage of the feeding device while the opening roll continues to run to be removed. Then, when the removal of the fibers from the nip during continuous feeding of fibers into the nip is ended, the undamaged fibers are deposited on the friction spinning elements and constitute a fiber accumulation there which is incorporated into the yarn end after said yarn end is back-fed, thus producing a piecing joint of great strength.

According to a preferred process, the fibers are brought through the nip onto the side of the friction spinning elements away from the nip, and are removed from there. In this way it is not necessary, for their removal, to greatly change the path of the fibers coming out of the fiber feeding channel. To remove the fibers it is advantageous if the spinning element normally rotating out of the nip is reversed in its rotation and is then again returned to its normal direction of rotation so that it again rotates out of the nip in order to terminate the removal of the fibers from the nip. Removal of the fibers if preferably effected by pneumatic, not by mechanical means.

Instead of going through the nip, the fibers can also be sucked away at a parallel to the nip, with a suction nozzle being used on the side of the friction spinning elements opposite to the draw-off side. The aspiration of the fibers from the nip is preferably ended by simply switching off the negative pressure prevailing outside the friction spinning elements.

For the removal of the fibers the two friction spinning elements are preferably spread apart in a radial direction, so that the fibers are removed in the simplest manner through the nip. In this case it is best if the two friction spinning elements are cleaned by being spread apart and by switching off the suction airstream from the friction spinning element which is subjected to suction, with the negative air pressure being again applied to the friction spinning element capable of being subjected to suction only when the two friction spinning elements have been returned into operating position.

In the sense of the instant invention, the "operating position" is understood to mean a position of the friction spinning elements which makes it possible to collect fibers in the nip formed by such elements and to incorporated them into a yarn end. For example, the friction spinning elements can in this case be so close to each other that the accumulation of fibers takes place in the nip on the fiber feeding side; depending upon the configuration of the open-end friction spinning device, it is however also possible to set the operating position so that the fibers are fed into a first nip on one side of the plane defined by the axles of the two friction spinning elements and are incorporated into the end of a yarn in a second nip which is constituted by the friction spinning elements on the other side of that plane.

To be able to control the stream of fibers to be spun into the yarn end, removal of the fibers is preferably not terminated suddenly, but instead gradually.

Since the back-feeding of the yarn into a readiness position for piecing, at least in its last phase, is normally carried out or assisted pneumatically, there is a danger, while fiber feeding is switched on, for the fibers to be sucked towards the yarn end and to attach themselves to it. When this occurs, no well-defined yarn end is available at the moment of piecing. To avoid this, a further variation of the process according to the instant invention provides for the yarn to be first brought into a readiness position outside the nip for piecing. This ensures that the fibers are brought into contact with the back-fed yarn end only at the desired moment, during the piecing process. Preferably, back-feeding of the yarn is controlled in such a manner that the yarn end is laid on the forming accumulation of fibers. In principle the friction spinning elements do not yet have to be driven in spinning direction before the introduction of the yarn into the nip, but it has been proven best if they are driven in spinning direction at the latest when the removal of the fibers from the nip is ended.

To carry out the process, the invention provides for a controllable air suction nozzle directed against the nip to be attributed to the fiber feeding channel. The air suction nozzle assigned to the fiber feeding channel has the role of sucking away the fibers from the nip for as long as said fibers are not yet to remain in the nip for incorporation into a yarn end.

According to a simple embodiment of the object of the invention the suction air nozzle can be located at the rear (with respect to the direction of yarn draw-off) of the friction spinning elements.

Preferably the suction air nozzle is arranged at that side of the friction spinning elements which is opposite the fiber feeding channel.

In this way the fibers to be removed need not be diverted on their way into the suction air nozzle.

In order to avoid an additional source of negative pressure for this suction air nozzle, the possibility should preferably be provided to switch the negative pressure from the suction air nozzle to the friction spinning element capable of being subjected to suction and back again. If a piecing device capable of travelling alongside a plurality of open-end friction spinning devices is provided, it is preferable if the negative pressure in the suction air nozzle and in the friction spinning element capable of being subjected to suction can be controlled from such travelling piecing device.

To be able to control the required flow of fibers required for piecing, a further preferred variation of the invention provides for the possibility of gradually adjusting the negative pressure taking effect in the suction air nozzle.

To remove the fibers from the nip, the friction spinning element rotating out of the nip can be provided with a controllable reversing clutch. The reversing clutch can be used to drive the friction spinning element rotating out of the nip during the spinning process temporarily in the direction of the nip, as is the case for the other friction spinning element. In this way, the fibers fed to the nip are fed through between the friction spinning elements, to be removed pneumatically or by means of a conveyor belt on the other side.

Alternately or in addition, the two friction spinning elements can also be designed so that they can be moved radially in relation to each other for the removal of the fibers.

To define different reproducible spinning positions for the open-end friction spinning device in a simple manner, the operating position of the two friction spinning elements can be set by means of a stop in another embodiment of the object of the invention.

To provide in a simple manner synchronization between the discontinuance of negative pressure in the suction air nozzle which removes the fibers and application of same to the friction spinning element or elements, an advantageous embodiment of the device according this invention provides that the negative pressure can be switched from the suction air nozzle to the friction spinning element capable of being subjected to suction and vice versa.

To prevent extraneous air from entering the housing in which the friction spinning elements are located, the method of bearing the movably supported friction spinning element is preferably constituted by a housing part which is supported on bearings and can be moved in relation to a housing part bearing the fixedly supported friction spinning element.

Since the position of the friction spinning elements determines whether the fibers are sucked away or are deposited in the nip on the friction spinning elements, the negative pressure in the suction air nozzle and in the friction spinning element capable of being subjected to the suction is preferably controllable in function of the position of the friction spinning elements.

The yarn end should not reach the nip for as long as the fibers are sucked out of said nip so that no fibers can attach themselves to the yarn end, as this would result in an undefined yarn end. For this reason, the yarn end is not fed directly to the nip but is fed by means of the friction spinning element rotating into the nip. For this purpose the invention provides for the housing to be provided with a yarn insertion slit facing the circumferential surface of the friction spinning element rotating into the nip. For this it is preferable for the friction spinning element turning into the nip to be fixedly supported, while the friction spinning element rotating out of the nip is movably supported in relation to the other friction spinning element. In this way the yarn can be deposited on the rotating friction spinning element even before the two friction spinning elements have again come into contact with each other.

The process and the device according to the invention makes it possible in a simple and secure manner for undamaged fibers to reach the nip of the open-end spinning device without any intervention in the fiber conveying path between delivery device and open-end friction spinning element being necessary. Thanks to the possibility of using undamaged fibers in the piecing process, a smaller amount of fiber suffices to achieve a given strength of the piecing joint than if damaged fibers must be used in said piecing joint. An unobtrusive piecing joint is the result. Since no interventions of any kind are required in the fiber conveying path, the quality of the yarn produced also remains unaffected, so that the piecing joint as well as the yarn produced following it have a good aspect and possess great strength.

DETAILED DESCRIPTION OF THE PREFERRED EMBODIMENTS

Examples of embodiments of the invention are illustrated in further detail through the drawings, in which.

Figure 1:
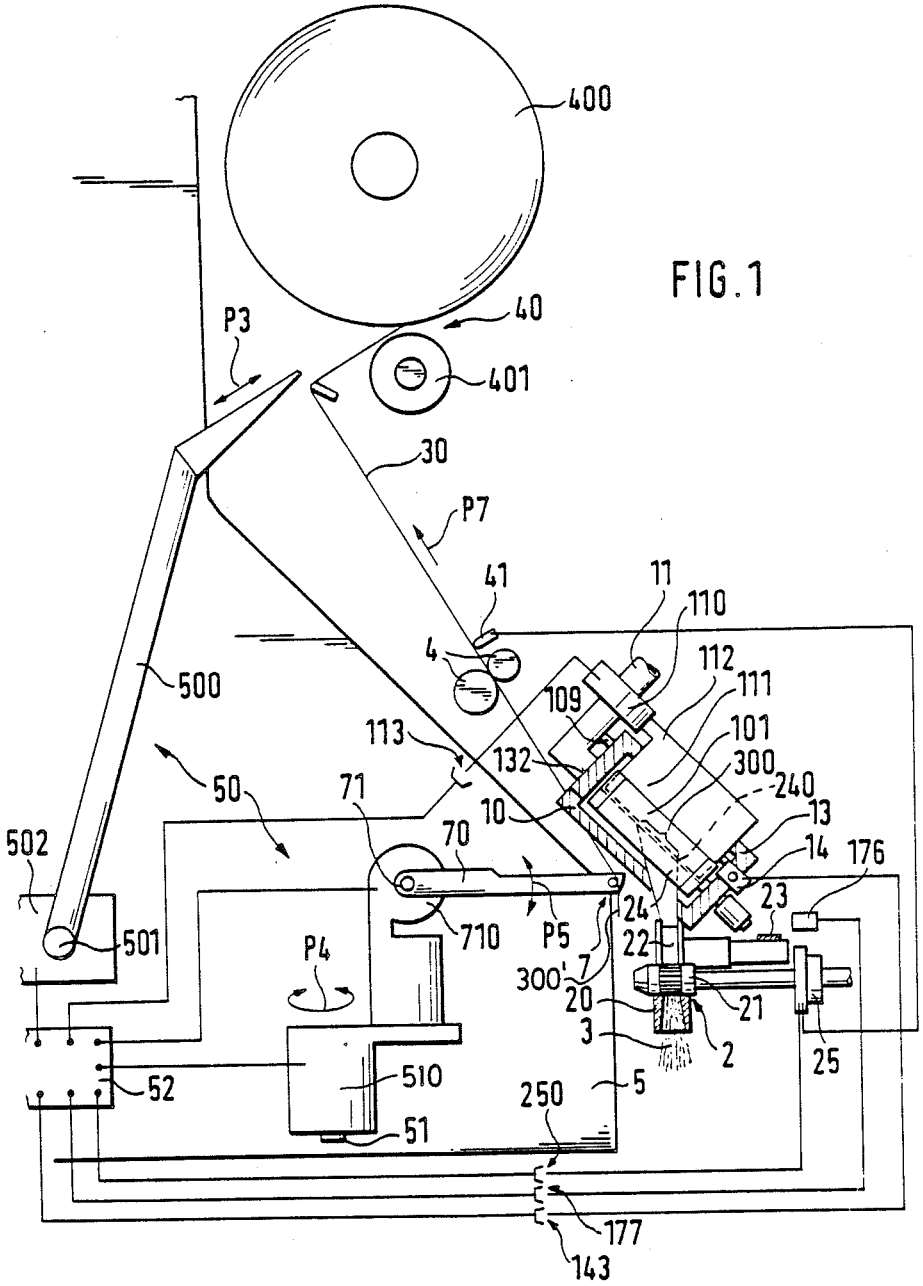
FIG. 1 is a schematic side-view of a spinning station with an open-end friction spinning device according to the invention.

FIG. 1 shows a spinning station with an open-end friction spinning device 10 to which the fiber material 3 is fed by means of a feeding and opening device 2. To draw off the spun yarn 30, a draw-off device 4 is provided. The yarn 30 which has been drawn off is wound by means of a winding device 40 on a bobbin 400 capable of being driven by a bobbin roll 401. A yarn monitor 41 is located in the path of the yarn, between the open-end friction spinning device 10 and the winding device 40.

The open-end friction spinning device 10 is equipped with a housing 13 with two rotationally symmetrical friction spinning elements 100 and 101 (FIGS. 2 and 3) which form a nip 102 therebetween. At least one of the friction spinning elements, for example the friction spinning element 100, is perforated and is subjected to suction in the area of the nip 102 during spinning. For this purpose a valve 110 is connected to a suction air line 11 (FIG. 1).

A suction air nozzle 111 is connected to the suction air line 11 via valve 110 and an intermediary line 112. This suction air nozzle 111 lets out in a second nip 105 formed by the friction spinning elements 100 and 101 opposite nip 102, on the other side of a plane E defined by the axles 103 and 104 (see FIG. 3) of the friction spinning elements 100 and 101. This suction air nozzle 111 is assigned to the fiber feeding channel 24 and serves to suck away the fibers not yet needed before yarn 30 is pieced.

Figure 3:
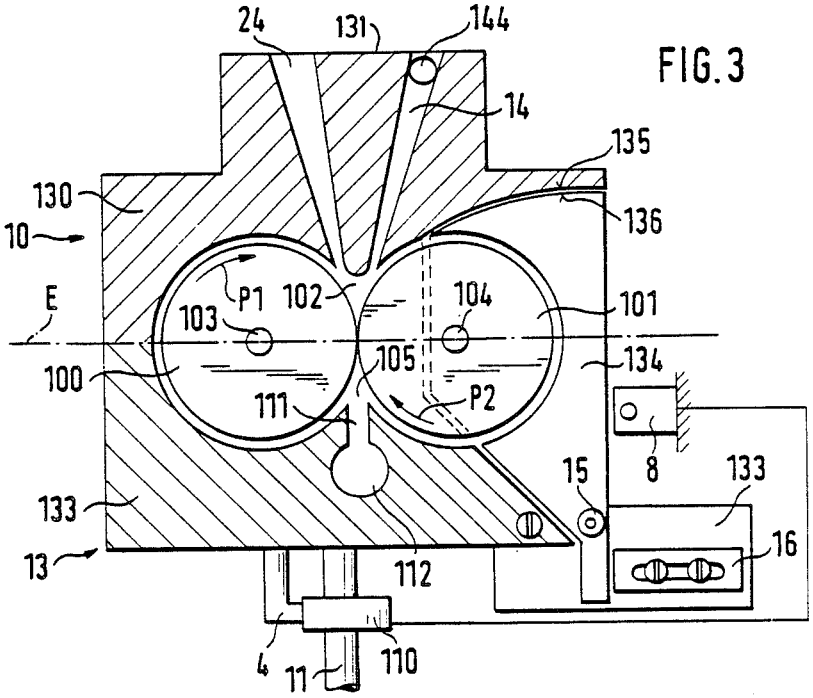
FIG. 3 is a cross-section through an open-end friction spinning device.

The two friction spinning elements 100 and 101 which, in the embodiment shown, are represented as rolls for the sake of simplification, are normally during spinning driven in the same direction (see arrows P1 and P2 in FIG. 3). For this purpose, each of the friction spinning elements 100 and 101 is provided with a wharve 107 or 108, by means of which they are driven by a drive belt 12 (FIGS. 4 and 5).

Figure 4:
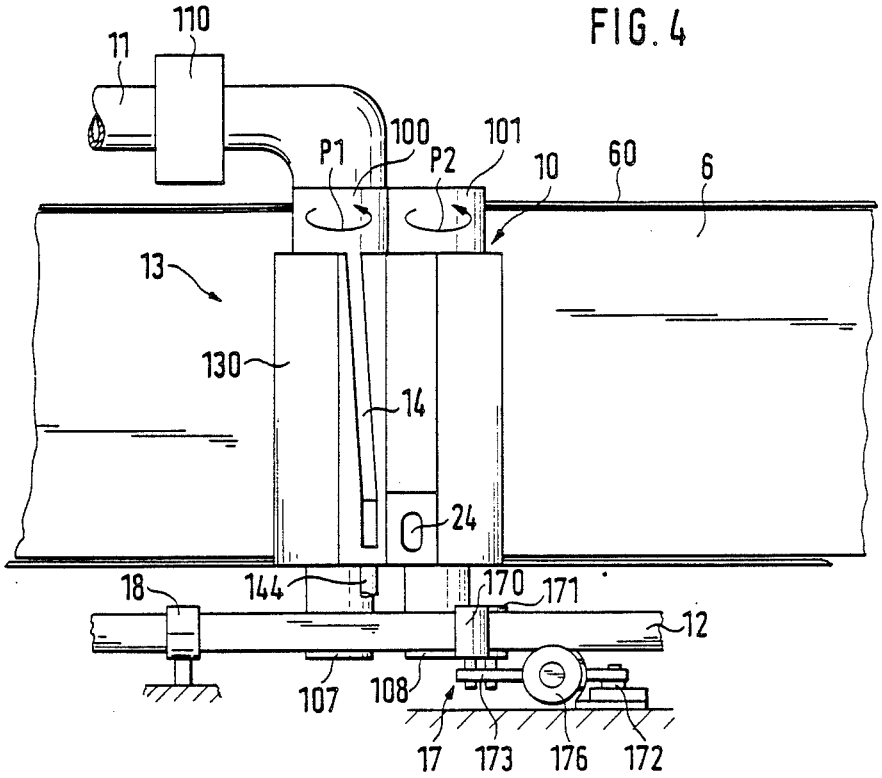
FIG. 4 is a top view of another embodiment of the object of the invention.
Figure 5:
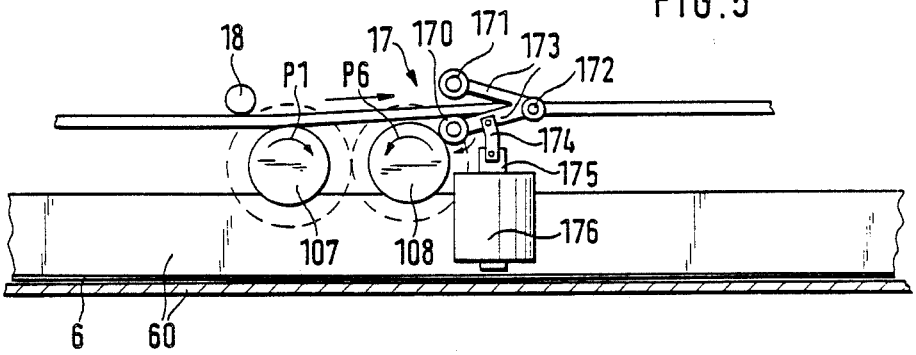
FIG. 5 is a front view of the device shown in FIG. 4.

The drive belt 12 is held in application against the wharve 108 by means of a fixed roll 18 (FIGS. 4 and 5). Associated with the wharve 108 of the friction spinning element 101 which rotates out of the nip is a controllable reversing clutch 17. In the example shown, this reversing clutch is provided with two rolls 170 and 171 which are located at the two ends of a cranked lever 173, capable of being swivelled around an axle 172. The roll 170 serves to hold belt 12 in application against wharve 108 when said drive belt 12 is released by roll 171. When roll 170 releases drive belt 12, roll 171 is simultaneously applied against drive belt 12 and against wharve 108, so that the friction spinning element 101 is driven in an opposite direction. The anchor 175 of a solenoid 176 is linkingly connected via a clutch link 174 to lever 173. For the sake of simplification, the solenoid 176 is the only part of this drive shown in FIG. 1.

Figure 2:
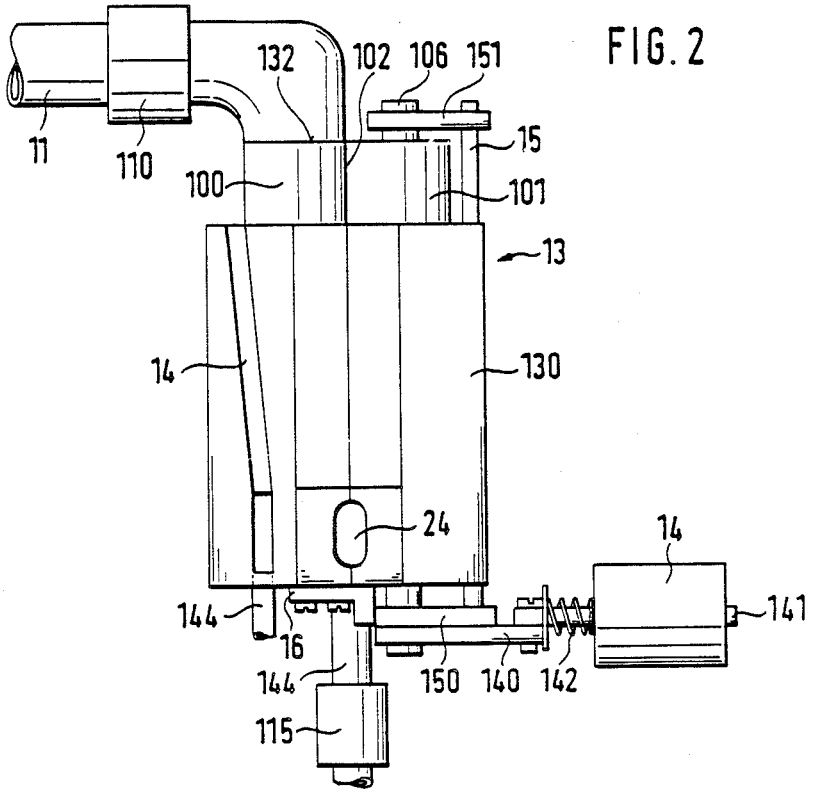
FIG. 2 is a top view of an open-end friction spinning device.

The housing 13 is designed so that the friction spinning element 101 can be swung away radially from friction spinning element 100. For this purpose it is supported by its axle 106 on two swivelling arms 150 and 151 which can in turn be swivelled around an axle 15 (FIG. 2). A clutch link 140, connected to the anchor 141 of a solenoid 14, is linked to the swivelling arm 150. On the anchor 141 a pull-back spring 142 is installed which bears against the anchor 141 and against the solenoid 14 in such a manner that it brings the friction spinning element 101 back into its operating position when the current in the solenoid 14 falls off. To determine this operating position, a stop 16, interacting with the swivelling arm 150, is installed on the housing 13.

The feeding and opening device 2 which precedes the open-end friction spinning device 10 is equipped with a feeding hopper 20 by means of which the sliver-shaped fiber material 3 is fed to a feeding roll 21 which interacts in the conventional manner with a pressure roller or a feeding trough (not shown). The feeding roll 21 is driven via a coupler 25 which is connected for control with yarn monitor 41. The fiber material 3 is fed from the feeding roll 21 to an opening roll 22 which opens the sliver-like fiber material 3 into individual fibers and feeds these to a yarn forming zone 300 where the individual fibers are incorporated into the end of the continuously withdrawn yarn 30. The opening roll 22 is driven in a known manner by means of a belt 23. A fiber feeding channel 24 extends from the opening roll 22 to the nip 102 of the friction spinning elements 100, 101.

A portion of the fiber feeding channel 24 is located in a cover 130 which covers the housing 13 and which is provided with a yarn insertion slit 14' alongside the fiber feeding channel 24. This yarn insertion slit 14' extends from the outside 131 of the cover 130 to the inside and runs alongside the side 132 of the housing 13 which is on the draw-off side, up to the outlet end 240 of the fiber feeding channel 24 on the side away from draw-off. The yarn insertion slit 14' ends on the outside 131 of the cover 130 in a controllable suction air nozzle 144. The yarn insertion slit 14' lets out next to the fiber feeding channel, opposite the circumferential surface of the friction spinning element 100.

Normally a machine is equipped with a plurality of identical spinning stations which interact with a service device 5 which can travel alongside these spinning stations. The open-end friction spinning device 10 and the feeding and opening device 2 are both installed in a stationary manner at the spinning station.

A piecing device 50 is installed in the service carriage 5 travelling alongside these spinning stations. It is equipped with a suction pipe 500 which can be swivelled around an axle 502 against bobbin 400 (arrow P3), and which serves to suck a yarn end from the bobbin 400. Bobbin 400 can be driven in unwinding direction from the service carriage 5 in a known manner, so that the sucked yarn end enters suction pipe 500 further and further. Suction pipe 500 is provided with a longitudinal slit (not shown) on its side towards the open-end friction spinning device 10 so that the aspired yarn segment can assume a stretched course between the slit end away from bobbin 400, near the swivelling axle 501 of the suction pipe 500 and the bobbin 400. At the same time the yarn enters the swivelling zone of a yarn clamp 7, of known type, having two clamping elements which can move in relation to each other so that they can alternately be brought into a holding position in which the two clamping elements are applied against each other, or into a releasing position in which they are spread apart.

The yarn clamp 7 is seated on the free end of an arm 70 which is supported on the servicing carriage 5 in such a manner that it can execute a first swivelling motion in a horizontal plane (arrow P4) around a first axle 51, and a second swivelling motion in a vertical plane (arrow P5) around a second swivelling axle.

Controls 52 are installed on the service device 5 and are connected in a controlling manner to a drive 502 to swivel the suction pipe 500 and to control the negative pressure inside suction pipe 500. These controls 52 are also connected to a drive 510 and to a drive 710 to swivel the fiber clamp 7. The service carriage 5 is connected in a controlling manner to the open-end friction spinning device 10 via electrical connections which can be switched on and off and which are represented in the embodiment shown in the drawing as contact plugs 113, 250, 143 and 177.

The device the assembly of which has been described above operates as follows:

When a yarn breakage occurs, the feeding roll 21 is stopped in a known manner by the yarn monitor 41 via coupler 25, so that no fibers reach the yarn forming zone 300 anymore. Furthermore, the bobbin 400 is lifted off from the bobbin roll 401 in a known manner and is held at a distance from the latter so that bobbin 400 can rotate freely.

When the service carriage 5, which either services one spinning station after the other or which is called to the affected spinning station by an error signal produced when an effort occur, has reached the spinning station, the connections between the service carriage 5 and the open-end friction spinning device are established via the plug connectors 113, 250, 143 and 117. The suction pipe 500 is then swivelled in direction of bobbin 400 and the latter is driven by an auxiliary drive (not shown) in unwinding direction. The yarn 30 is thus unwound and sucked into the suction pipe 500. When the suction pipe 500 has accepted a sufficient length of yarn, suction pipe 500 is swivelled away. At the same time the yarn 30 emerges from the above-mentioned longitudinal slit. In this process it assumes a stretched course between the end of the longitudinal slit on the side of the swivelling axle 501 and the bobbin 400. The yarn 30 is thus located within the swivelling range of the horizontally and vertically swivelling yarn clamp 7. The latter is brought into yarn accepting position within the yarn's path where it accepts yarn 30. It guides yarn 30 to a cutting device (not shown), located in the service carriage, which cuts through the yarn 30 on the side of yarn clamp 7 away from bobbin 400. A determined yarn length is thus created between yarn clamp 7 and the free yarn end, as is required for piecing. The yarn clamp 7 is then swivelled in a combined horizontal and vertical motion toward the open-end friction spinning device 10. It is thus brought into a yarn transferring position in front of the yarn insertion slit 14 to which it presents yarn end 300. At the same time it hold the yarn 30 in a position which is essentially parallel to the yarn insertion slit 14' by means of suction air nozzle 144 which is controlled from the service carriage 5.

During this back-feeding of the yarn 30 into its readiness position in front of the yarn insertion slit 14' the controls 52 of the piecing device 50 activate the solenoid 14 which swivels the friction spinning element 101 away from the friction spinning element 100. In addition, the controls 52 excite the solenoid 176 so that it pushes roll 171 between wharve 108 and drive belt 12. In this way the friction spinning elements 100 and 101 are no longer driven in the same direction but are both rotated into the nip 102 (see arrows P1 and P6 in FIG. 5). The controls 52 furthermore activate valve 110 which takes the negative pressure out of the friction spinning element 100 and in turn produces negative pressure in the suction air nozzle 111.

The controls 52 now again switch on fiber feeding to nip 102 via coupler 25. Since the two friction spinning elements 100 and 101 are now spread apart, the fibers pass between said two friction spinning elements 100 and 101 into nip 105, from which they are again removed immediately by the negative pressure in suction air nozzle 111. In this way the fibers which had been damaged before as the opening roll 22 continued to run while the feeding roll 21 was stopped are removed. The rotation of the two friction spinning elements 100 and 101 in direction of the nip 102 ensures that the fibers which are deposited on one of the rotating friction spinning elements 100 and 101 are also brought to the suction air nozzle 11 by their rotation and are thus removed.

The friction spinning elements 100 and 101 are freed from fibers adhering to their circumferential surfaces and are thus cleaned by the negative pressure in the suction air nozzle 111 when said two friction spinning elements 100 and 101 are spread apart and when the suction air to which it can be subjected is switched off from friction spinning element 100. This cleaning process is simultaneous with the removal of the fibers fed into the nip and ends when the friction spinning elements 100 and 101 are again brought back into their operating position determined by stop 16.

After a period of time which is calculated to ensure that all damaged fibers are combed out of the fiber tuft and are removed by the suction air nozzle 111, simultaneous activation (or deactivation) of the solenoids 176 and 14 causes the friction spinning element 101 to return to its operating position relative to friction spinning element 100 and furthermore causes it to be again driven in its normal direction of rotation (arrow P2). Valve 11 is furthermore switched over, so that the friction spinning element 100 is again subjected to suction.

Due to the switching steps enumerated above, the removal of fibers from the open-end friction spinning device is stopped and the fibers remaining in nip 102 now form a rotating fiber mass. At a point in time coordinated with that event, the yarn 30 being held by the yarn clamp 7 is released by the latter.

Yarn 30 now enters into the yarn insertion slit 14' and reaches the circumferential surface of the friction spinning element 100 which rotates in direction of the nip 102. When it has reached the yarn forming zone 300, the yarn 30 connects with the rotating fiber mass. Through the lowering of bobbin 400 on the bobbin roll 401, yarn 30, which now continuously incorporates the fibers fed to the yarn forming zone 300, is introduced into the draw-off device 4 which effects the continued withdrawal of yarn 30 from the yarn forming zone 300.

The open-end friction spinning device 10 described above can be varied in different ways, whereby variations are possible by interchanging of characteristics or by replacing them with equivalents or through combinations of characteristics.

In the embodiment described, the elements 100 and 101 are rotated in direction of the nip for the removal of the fibers before feeding the yarn to the yarn forming zone, and furthermore the friction spinning elements 100 and 101 are radially spread apart to leave a gap between them. Here it is also possible to stop the friction spinning elements 100 and 101 if desired unit they have returned into their spinning position. To remove the fibers it also suffices to either spread apart the friction spinning elements 100 and 101 radially or to rotate both friction spinning elements 100 and 101 in direction of the nip 102. In the latter case the fibers fed to the nip 102 are deposited on the circumferential surfaces of the friction spinning elements 100 and 101 and, as these rotate, reach nip 105 on the other side of the plane E defined by the axles 103 and 104 of the friction spinning elements 100 and 101. The fibers are hurled downward by the friction spinning elements 100 and 101 and are then sucked into the suction air nozzle 111, Instead of a suction air nozzle a conveyor belt 6, which may run inside a guide 60 for protection against lateral airstreams, can also be provided (FIGS. 4 and 5). In this case the removal of the fibers is purely mechanical, effected by the reversal of the direction of rotation of the friction spinning element 101 which rotates out of the nip 102 during the spinning process, so that it rotates into nip 102 as does friction spinning element 100, and by means of the conveyor belt 6. The removal of fibers is ended by again reversing the direction of the friction spinning element 101, so that it again rotates out of nip 102.

In the embodiment shown in FIG. 1 the fibers are sucked away by a suction air nozzle 111 assigned to the fiber feeding channel 24. This has the advantage that the fibers go into a system closed to the outside immediately upon leaving nip 102. In principle it is not absolutely necessary to install the suction air nozzle 111 in front of the fiber feeding channel 24, as is the case according to FIG. 1. If the two friction spinning elements 100 and 101 can be spread apart radially it is absolutely possible to provide a suction air nozzle 114, controlled by a valve 115, at the rear, in relation to yarn withdrawal, of the friction spinning elements 100 and 101, i.e. at their side away from draw-off side 132. This valve can be controlled by the controls 52 on the service carriage 50, just as is valve 110. In that case the fibers are sucked out of nip 102 in a parallel direction to said nip, and therefore must be deflected more than in the device shown in FIG. 1. However, this can be compensated by negative pressure of appropriate intensity in the suction air nozzle 114. In that case the fibers are taken out of nip 102 by controlling valve 115, i.e. by switching off the negative pressure which takes effect in suction air nozzle 114, outside the friction spinning elements 100 and 101.

In principle, separately controllable valve 110 and 115 can be provided for the negative pressure in the friction spinning elements 100 and 101 on the one hand and in the suction air nozzle 111 or 114 on the other hand. But since the end of yarn removal from the nip 102 and the switching on of suction at the friction spinning element 100 capable of being subjected to suction air is synchronized as a rule, this is accomplished most simply by means of a reversing valve.

Depending on the manner of resumption of the spinning process, it may also be desirable to resume the feeding of the fiber stream to the nip and to accumulate them therein gradually and not suddenly. This can be achieved through appropriate control of the negative pressure in the suction air nozzle 111 or 114 and/or of the speed at which the friction spinning elements 100 and 101 are returned into their spinning position after having been spread apart.

FIG. 3 shows a further variant of an open-end friction spinning device 10. In this embodiment the fiber feeding channel 24 and the yarn insertion slit 14' end side by side in nip 102. Yarn 30 therefore need not be brought first into the nip 102 by the rotation of the friction spinning element 100. It is also possible to feed the yarn 30 directly to the nip 102 while the fibers are deposited on the circumferential surface of the friction spinning element 100 which rotates into nip 102. In such an embodiment the fibers can also be removed from nip 102 by either mechanical or pneumatic means.

Since the control of the negative pressure in the friction spinning element 100 capable of being subjected to suction and in suction nozzle 111 or 114 must be synchronized with the movement of the friction spinning element 101 which can be spread away from the stationary friction spinning element 100, a switch 8 is provided according to FIG. 3, to control valve 110 in order to switch the negative pressure from the friction spinning element 100 capable of being subjected to suction over to the suction air nozzle 111 and vice versa.

Housing 13 is equipped with a stationary housing part 133 which accepts friction spinning element 100, capable of being subjected to suction and which rotates into the nip 102. In this way also those fibers which are not fed directly to the suction air nozzle 111 but remain in the area of the outlet of fiber feeding channel 24 are fed by friction spinning element 100 to the suction air nozzle 11. The friction spinning element 101 which normally rotates out of nip 102 is supported on a housing part 134 capable of being swivelled around an axle 15 in such manner as to be movable in relation thereto. Each of the housing parts 133 and 134 is equipped with a guiding and sealing surface 135 and 136, respectively, which is concentric to axle 15, so that housing 13 is sealed off adequately even when the friction spinning element 101 is in its switched-off position. Here too, the operating position of the movable friction spinning element 101 is ensured by a stop 16 which is adjustable with respect to the stationary housing part 133.

As soon as the housing part 134, together with friction spinning element 101 has moved away somewhat from housing part 133, switch 8 is contacted and switches the negative pressure over. If desired, switch 8 can also be adjustably attached on the stationary housing part 133.

It has always been assumed above that certain equivalents and reversal of parts are included aspects of this invention, for example that friction element 100 may be rendered movable with respect to a stationary friction spinning element 101. It is however also possible for both friction spinning elements 100 and 101 to move simultaneously so as to accomplish generally the same functions.

What is claimed is:

1. Process to piece to an open-end friction spinning device of the type having two spinning elements normally rotating in the same direction, and forming a nip therebetween in which fibers fed thereto are formed into yarn during such normal spinning rotation of the spinning elements, said process comprising the steps of: feeding fibers continuously to the nip; first removing the fibers from the nip without forming yarn therefrom; then driving the friction spinning elements in their normal spinning direction while terminating such fiber removal; subsequently back-feeding a free yarn end to the forming fiber accumulation in the nip from a piecing-readiness position of such free yarn end which position is located outside said nip, and then drawing continuous yarn off from the nip while continuously incorporating into such yarn the fibers being fed to the nip.

2. Process to piece to an open-end friction spinning device of the type having two spinning elements normally rotating in the same direction, and forming a nip therebetween in which fibers fed thereto are formed into yarn during such normal spinning rotation of the spinning elements, said process comprising the steps of: feeding fibers continuously to the nip; first removing the fibers from the nip without forming yarn therefrom; then driving the friction spinning elements in their normal spinning direction while terminating such fiber removal; subsequently back-feeding a free yarn end to the forming fiber accumulation in the nip and then drawing continuous yarn off from the nip while continuously incorporating into such yarn the fibers being fed to the nip, further wherein during fiber removal the fibers pass through the nip to the side of the friction spinning elements opposite to such nip and are removed from such opposite side.

3. Process as in claim 2, characterized in that one of the friction spinning elements, which during normal spinning rotates out of the nip, is reversed in its rotation during the removal of the fibers from the nip, and is subsequently reversed again to be brought back into its normal spinning direction of rotation so as to again rotate out of the nip, thereby ending fiber removal from the nip.

4. Process an in claim 1, characterized in that the fibers are removed by pneumatic means.

5. Process as in claim 4, characterized in that the fibers are sucked out of the nip in a direction parallel to said nip.

6. Process as in claim 4, characterized in that the removal of the fibers from the nip is discontinued by switching off negative pressure prevailing outside the friction spinning elements.

7. Process to piece to an open-end friction spinning device of the type having two spinning elements normally rotating in the same direction, and forming a nip therebetween in which fibers fed thereto are formed into yarn during such normal spinning rotation of the spinning elements, said process comprising the steps of: feeding fibers continuously to the nip; first removing the fibers from the nip without forming yarn therefrom; then driving the friction spinning elements in their normal spinning direction while terminating such fiber removal; subsequently back-feeding a free yarn end to the forming fiber accumulation in the nip and then drawing continuous yarn off from the nip while continuously incorporating into such yarn the fibers being fed to the nip, further wherein, the two friction spinning elements are spread apart in a radial direction during the removal of the fibers.

8. Process to piece to an open-end friction spinning device of the type having two spinning elements normally rotating in the same direction, and forming a nip therebetween in which fibers fed thereto are formed into yarn during such normal spinning rotation of the spinning elements, said process comprising the steps of: feeding fibers continuously to the nip; first removing the fibers from the nip without forming yarn therefrom; then driving the friction spinning elements in their normal spinning direction while terminating such fiber removal; subsequently back-feeding a free yarn end to the forming fiber accumulation in the nip and then drawing continuous yarn off from the nip while continuously incorporating into such yarn the fibers being fed to the nip, further wherein the fibers are removed by pneumatic means, and the two friction spinning elements are cleaned and the fibers removed from the nip thereof by spreading the spinning elements apart while continuing to rotate same and by switching off suction air from the friction spinning element adapted to be subjected to suction, whereby such friction spinning element is subsequently subjected to negative air pressure when the two friction spinning elements have again been brought into their defined adjacent operating position.

9. Process as in claim 7, wherein the removal of the fibers from the nip is characterized by return of the friction spinning elements into their defined adjacent operating position.

10. Process as in claim 1, characterized in that the removal of fibers is ended gradually.

11. Process as in claim 1, characterized in that the yarn is brought into a piecing-readiness position outside the nip and in that the feeding of fibers into the nip is only commenced thereafter.

12. Process as in claim 11, characterized in that the free yarn end is laid upon the forming fiber accumulation from it piecing-readiness position.

13. Process as in claim 1, characterized in that driving of the friction spinning elements in their normal spinning directions is synchronized with termination of fiber removal from the nip.

14. An open-end friction spinning device, comprising:

a pair of rotatable friction spinning elements defining a nip therebetween in which yarn is formed, whenever fibers are fed to such nip and said spinning elements are rotated in the same spinning direction, during spinning operations;

fiber feeding channel means for selectively feeding fibers to said nip from a given side thereof;

yarn handling means for controllably drawing off yarn formed in said nip from a given side thereof, and alternatively feeding a free yarn end back to said nip;

spinning element drive means for controllably rotating said spinning elements;

controllable fiber removal means operatively associated with said nip for controllably removing fibers therefrom without same being formed into thread; and piecing control means, operative during piecing operations, for controlling the feeding of a free yarn end back to said nip, and subsequently drawing same off from said nip with additional fibers continuously tied thereinto, wherein said piecing control means also selectively controls said fiber removal means to remove damaged and excessive amounts of fibers from said nip and said spinning elements even while said fiber feeding channel means is operative, then build a fiber accumulation in said nip with fibers fed thereto by said fiber feeding channel means, and then controls said yarn handling means for subsequently tying said free yarn end into such fiber accumulation beginning from a free yarn end piecing-readiness position located outside of said nip and thereafter drawing off continuous yarn from said nip with fiber fed thereto continuously tied in therewith so as to form such continuous yarn.

15. Device as in claim 14, wherein:

one of said spinning elements is adapted to receive spinning suction during spinning operations, which suction is not active during piecing operations;

said controllable fiber removal means includes a suction source which is directed against said nip during piecing operations but which is generally not active during spinning operations; and wherein said piecing control means includes means for respectively alternating activation of the aforementioned spinning suction and suction source between the respective spinning operations and piecing operations.

16. Device as in claim 15, characterized in that such suction alternating can be controlled from a piecing device operative for travelling alongside a plurality of open-end friction spinning devices.

17. Device as in claim 14, characterized in that said controllable fiber removal means includes a suction air nozzle located at the rear of said friction spinning elements relative yarn draw-off therefrom.

18. Device as in claim 14, characterized in that said controllable fiber removal means includes a suction air nozzle located on the side of said friction spinning elements which is opposite from that which faces said fiber feeding channel means.

19. Device as in claim 14, characterized in that said fiber removal means includes negative pressure in a suction air nozzle, which pressure can be adjusted gradually.

20. An open-end friction spinning device, comprising:

a pair of rotatable friction spinning elements defining a nip therebetween in which yarn is formed, whenever fibers are fed to such nip and said spinning elements are rotated in the same spinning direction, during spinning operations;

fiber feeding channel means for selectively feeding fibers to said nip from a given side thereof;

yarn handling means for controllably drawing off yarn formed in said nip from a given side thereof, and alternatively feeding a free yarn end back to said nip;

spinning element drive means for controllably rotating said spinning elements;

controllable fiber removal means operatively associated with said nip for controllably removing fibers therefrom without same being formed into thread; and piecing control means, operative during piecing operations, for controlling the feeding of a free yarn end back to said nip, and subsequently drawing same off from said nip with additional fibers continuously tied thereinto, wherein said piecing control means also selectively controls said fiber removal means to remove damaged and excessive amounts of fibers from said nip and said spinning elements even while said fiber feeding channel means is operative, then build a fiber accumulation in said nip with fibers fed thereto by said fiber feeding channel means, and then controls said yarn handling means for tying said free yarn end into such fiber accumulation and thereafter drawing off continuous yarn from said nip with fiber fed thereto continuously tied in therewith so as to form such continuous yarn, further wherein said spinning element drive means includes a controllable reversing clutch for selectively rotating both of said spinning elements into said nip thereof.

21. An open-end friction spinning device, comprising:

a pair of rotatable friction spinning elements defining a nip therebetween in which yarn is formed, whenever fibers are fed to such nip and said spinning element are rotated in the same spinning direction, during spinning operations;

fiber feeding channel means for selectively feeding fibers to said nip from a given side thereof;

yarn handling means for controllably drawing off yarn formed in said nip from a given side thereof, and alternatively feeding a free yarn end back to said nip;

spinning element drive means for controllably rotating said spinning elements;

controllable fiber removal means operatively associated with said nip for controllably removing fibers therefrom without same being formed into thread; and piecing control means, operative during piecing operations, for controlling the feeding of a free yarn end back to said nip, and subsequently drawing same off from said nip with additional fibers continuously tied thereinto, wherein said piecing control means also selectively controls said fiber removal means to remove damaged and excessive amounts of fibers from said nip and said spinning elements even while said fiber feeding channel means is operative, then build a fiber accumulation in said nip with fibers fed thereto by said fiber feeding channel means, and then controls said yarn handling means for tying said free yarn end into such fiber accumulation and thereafter drawing off continuous yarn from said nip with fiber fed thereto continuously tied in therewith so as to form such continuous yarn, and further including radial spacer means for moving said friction spinning elements radially with respect to each other.

22. Device as in claim 21, characterized in that an adjacent operating spinning position of said friction spinning elements can be adjusted by a stop element.

23. Device as in claim 21, characterized in that support of a movable one of said friction spinning elements is constituted by a housing part which is supported movably with respect to a relatively fixed housing part which relatively fixedly supports the other friction spinning element.

24. Device as in claim 23, characterized in that spinning suction in one of the friction spinning elements and operation of said controllable fiber removal means can be alternatively controlled as a function of the position of said friction spinning elements.

25. An open-end friction spinning device, comprising:

a pair of rotatable friction spinning elements defining a nip therebetween in which yarn is formed, whenever fibers are fed to such nip and said spinning elements are rotated in the same spinning direction, during spinning operations;

fiber feeding channel means for selectively feeding fibers to said nip from a given side thereof;

yarn handling means for controllably drawing off yarn formed in said nip from a given side thereof, and alternatively feeding a free yarn end back to said nip;

spinning element drive means for controllably rotating said spinning elements;

controllable fiber removal means operatively associated with said nip for controllably removing fibers therefrom without same being formed into thread; and piecing control means, operative during piecing operations, for controlling the feeding of a free yarn end back to said nip, and subsequently drawing same off from said nip with additional fibers continuously tied thereinto, wherein said piecing control means also selectively controls said fiber removal means to remove damaged and excessive amounts of fibers from said nip and said spinning elements even while said fibers feeding channel means is operative, then build a fiber accumulation in said nip with fibers fed thereto by said fiber feeding channel means, and then controls said yarn handling means for tying said free yarn end into such fiber accumulation and thereafter drawing off continuous yarn from said nip with fiber fed thereto continuously tied in therewith so as to form such continuous yarn, and further comprising a housing accepting said friction spinning elements, said housing including a yarn insertion slit which ends in front of the circumferential surface of one of the friction spinning elements which during spinning operation normally rotates into said nip.

26. Device as in claim 21, characterized in that the friction spinning element normally rotating into said nip during spinning operations is supported fixedly, while the other friction spinning element normally rotating out of said nip during spinning operations is supported movably in relation to the other friction spinning element.

27. Process as in claim 5, characterized in that the removal of the fibers from the nip is discontinued by switching off negative pressure prevailing outside the friction spinning elements.

28. Process as in claim 7 characterized in that the two friction spinning elements are cleaned and the fibers are removed from the nip thereof by the radial spreading of such spinning elements, and by switching off suction air from the friction spinning element adapted to be subjected to suction, whereby such friction spinning element is subsequently subjected to negative air pressure when the two friction spinning elements have again been brought into their defined adjacent operating position.

29. Process as in claim 8, wherein the removal of the fibers from the nip is characterized by return of the friction spinning elements into their defined adjacent operating position.

30. A method of piecing yarn on an open-end friction spinning apparatus of the type having a pair of controllably rotatable spinning elements, defining a yarn-forming nip generally therebetween and situated on one side of a plane defined by the rotation axes of such spinning elements, and bobbin means for taking up yarn formed in such nip, said method comprising the steps of:

suspending yarn take up operations of the bobbin means;

securing and returning a free end of previously taken up yarn to a defined piecing-readiness position relatively adjacent the yarn-forming nip;

removing fibers from such nip continuously fed thereto, and before such fibers are formed into yarn, by conveying same through the plane defined by the spinning elements rotation axes, so as to clean any damaged fibers from the spinning elements;

ending said removing step after a predetermined period of time while rotating both of the spinning elements in defined normal spinning directions thereof, and while continuing to feed fibers to the nip so as to permit fibers to accumulate in such yarn-forming nip;

conveying the yarn free end from its piecing-readiness position to the yarn-forming nip whereupon it is pieced with fibers continuously fed thereto and formed into yarn; and resuming take up operations of the bobbin means; whereby faultless secure piecing of yarn is accomplished without using any damaged fibers and without having to suspend fiber feeding.

31. A method as in claim 30, wherein said removing step includes rotating both of said spinning elements into the yarn-forming nip so that fibers previously in the nip and those continuously fed thereto will be cleared therefrom without forming yarn.

32. A method as in claim 31, wherein said removing step includes providing suction directed towards the nip from the other side of the defining plane relative thereto, so as to collect fibers being removed.

33. A method as in claim 30, wherein said removing step includes providing suction directed towards the nip from the other side of the defined plane relative thereto, so as to collect fibers being removed.

34. A method as in claim 31, wherein said removing step includes providing a conveyor belt beneath the nip on the other side of the defined plane relative thereto, for collecting and transporting fibers being removed.

35. A method as in claim 30, wherein said removing step includes axially separating the spinning elements so that fibers pass through the nip to be removed therefrom.

36. A method as in claim 31, wherein said removing step includes axially separating the spinning elements so that fibers pass through the nip to be removed therefrom.

37. A method as in claim 30, wherein said removing step includes stopping rotation of the spinning elements, the normal spinning rotations of which are in the same direction so that one of the spinning elements during spinning operation rotates into the yarn-forming nip while the other spinning element rotates out of such nip.

38. A method as in claim 32, wherein said suction is provided by a controllable suction air nozzle situated on the other side of the defined plane from the nip, and opposite an area where fibers are fed to the yarn-forming nip.

39. A method as in claim 35, wherein said removing step further includes providing suction at an axial end of the spinning elements opposite to that from a yarn take-up side thereof.

40. A method as in claim 30, wherein said ending step includes gradually ending the removing fibers step so that fibers accumulate gradually in the nip so as to prevent damaging such fibers.

41. An open-end friction spinning apparatus, comprising:

a pair of controllably rotatable spinning elements defining a yarn-forming nip generally therebetween and situated on one side of a plane defined by the rotation axis of such spinning elements;

bobbin means for selectively taking up yarn formed in said nip;

means for suspending yarn take-up operation of said bobbin means;

means for securing and returning a free end of yarn previously taken up with said bobbin means to a defined piecing-readiness position relatively adjacent said yarn-forming nip;

fiber feeding channel means for continuously feeding fibers to said nip;

means for removing fibers from said nip continuously fed thereto, and before said fibers are formed into yarn, by conveying same through said plane defined by the spinning elements rotation axes, so as to clear any damaged fibers from said spinning elements;

means for ending said fiber removal after a predetermined period of time while rotating both of said spinning elements in a common direction so as to define normal spinning rotation directions thereof, to permit fibers fed to said yarn-forming nip by said fiber feeding channel means to accumulate therein;

means for conveying said yarn free end from its piecing-readiness position to said nip whereupon it is pieced with fibers continuously fed to such nip and formed into continuous yarn by said normal spinning rotations of said spinning elements; and means for resuming take-up operations of said bobbin means; whereby faultless secure piecing of yarn is accomplished without using any damaged fibers and without having to suspend operation of said fiber feeding channel means.

42. An apparatus as in claim 41, wherein said means for removing fibers includes reversible clutch means for selectively rotating both of said spinning elements into said nip therebetween so that fibers present in the nip and continuously fed thereto are cleared from such spinning elements without forming yarn therefrom.

43. An apparatus as in claim 42, wherein said means for removing fibers further includes controllable suction air nozzle means directed toward said nip from the other side of said defined plane relative thereto, for collecting fibers being removed from said nip.

44. An apparatus as in claim 41, wherein said means for removing fibers includes controllable suction air nozzle means directed toward said nip from the other side of said defined plane relative thereto, for collecting fibers being removed from said nip.

45. An apparatus as in claim 42, wherein said means for removing fibers further includes conveyor belt means, positioned beneath said nip on the other side of said defined plane relative thereto, for collecting and transporting fibers being removed from said nip.

46. An apparatus as in claim 41, wherein said means for removing fibers includes means for controllably axially separating said spinning elements so that fibers pass through said nip thereof to be removed therefrom.

47. An apparatus as in claim 42, wherein said means for removing fibers further includes means for controllably axially separating said spinning elements so that fibers pass through said nip thereof to be removed therefrom.

48. An apparatus as in claim 41, wherein said mean for removing fibers includes means for suspending rotation of said spinning elements during operation of said means for removing fibers.

49. An apparatus as in claim 43, wherein said controllable suction air nozzle is located on the other side of said defined plane from said yarn-forming nip, and opposite an area where fibers are fed to said yarnforming nip by said fiber feeding channel means.

50. An apparatus as in claim 46, wherein said means for removing fibers further includes controllable suction air nozzle means situated at an axial end of said spinning elements opposite to that from which said yarn take-up operations are performed.

51. An apparatus as in claim 41, wherein said means for ending said fiber removable include means for gradually returning fibers to said yarn-forming nip for accumulation therein so as to prevent damaging such fibers.

* * * * *